US011525302B2

(12) United States Patent
Earles et al.

(10) Patent No.: US 11,525,302 B2
(45) Date of Patent: Dec. 13, 2022

(54) PROTECTIVE SCREEN SYSTEM AND METHOD OF INSTALLATION

(71) Applicants: Jason Earles, Fort McMurray (CA); Eugene Strickland, Fort McMurray (CA)

(72) Inventors: Jason Earles, Fort McMurray (CA); Eugene Strickland, Fort McMurray (CA)

( * ) Notice: Subject to any disclaimer, the term of this patent is extended or adjusted under 35 U.S.C. 154(b) by 0 days.

(21) Appl. No.: 17/373,860

(22) Filed: Jul. 13, 2021

(65) Prior Publication Data

US 2021/0340814 A1 Nov. 4, 2021

Related U.S. Application Data

(63) Continuation of application No. 16/690,018, filed on Nov. 20, 2019, now abandoned, which is a continuation of application No. 15/452,679, filed on Mar. 7, 2017, now abandoned.

(51) Int. Cl.

| | |
|---|---|
| ***E06B 9/52*** | (2006.01) |
| ***E06B 7/32*** | (2006.01) |
| ***E06B 7/02*** | (2006.01) |

(52) U.S. Cl.

CPC ..... *E06B 9/52* (2013.01); *E06B 7/02* (2013.01); *E06B 7/32* (2013.01)

(58) Field of Classification Search

CPC .... E06B 9/52; E06B 5/003; E06B 2003/7011; E06B 3/5892; E06B 3/7001; E06B 7/32; E06B 2009/002; Y10T 29/49732–49737; Y10T 29/49716; B23P 6/00

See application file for complete search history.

(56) References Cited

U.S. PATENT DOCUMENTS

| | | | | | |
|---|---|---|---|---|---|
| 236,532 | A * | 1/1881 | Bassett | E06B 3/7009 | 160/96 |
| 498,833 | A * | 6/1893 | Wise | E06B 9/52 | 160/17 |
| 1,022,547 | A * | 4/1912 | Hansen | E06B 9/52 | 160/91 |
| 1,207,885 | A * | 12/1916 | Estabrook | E06B 9/52 | 160/90 |
| 1,573,194 | A * | 2/1926 | Roe | E06B 9/52 | 160/91 |

(Continued)

*Primary Examiner* — Justin B Rephann

(74) *Attorney, Agent, or Firm* — Argus Intellectual Enterprise; Jordan Sworen; Daniel Enea

(57) ABSTRACT

A protective screen system and method of installation for preventing bugs and insects from passing through a door or window opening, as well as preventing pets, such as dogs and cats from causing damage to a protective screen. The system and method include removing an existing screen from a door or window frame and inserting a protective screen member through a front face of the frame. The protective screen member is a rigid, transparent panel having a plurality of spaced apertures forming a grid pattern. The protective screen member is positioned through an opening of the frame and within a groove thereof such that an entire outer perimeter of the protective screen member is seated within the door or window frame. The protective screen member is secured to the frame via application of a fastener such as an adhesive or tape.

17 Claims, 3 Drawing Sheets

(56) References Cited

U.S. PATENT DOCUMENTS 2,294,966 A * 9/1942 Dreyfus ..... E06B 9/52 156/1
2,634,146 A * 4/1953 Johnson ..... E05C 3/042 292/240
3,084,737 A * 4/1963 Stevens ..... E06B 7/02 49/63
3,094,058 A * 6/1963 O'Brien, Jr. ..... F24F 13/12 454/211
4,001,972 A * 1/1977 Hurwitz ..... E06B 5/003 49/382
4,222,162 A * 9/1980 Levy ..... E06B 9/52 29/402.09
4,546,693 A * 10/1985 McTaw, Jr. ..... B60J 1/16 296/217
4,856,575 A * 8/1989 Wells ..... A01K 1/035 29/445
5,048,587 A * 9/1991 York ..... E06B 9/52 160/217
5,056,262 A * 10/1991 Schweiss ..... E05C 19/006 49/257
5,570,542 A * 11/1996 Cameron ..... B60J 1/2011 49/55
5,768,826 A * 6/1998 Wilcher ..... B60J 1/17 49/31
6,109,328 A * 8/2000 Montana ..... E06B 9/52 49/168
6,250,040 B1 * 6/2001 Green ..... E06B 3/72 52/656.9
6,805,937 B1 * 10/2004 Toth ..... E06B 9/52 29/402.09
7,063,374 B1 * 6/2006 Cameron ..... B60J 1/2011 89/36.02
8,484,896 B1 * 7/2013 Skubiak, Jr. ..... E06B 9/52 160/369
8,662,971 B2 * 3/2014 Warner ..... E06B 7/08 454/243
10,006,242 B2 * 6/2018 Anderson ..... E06B 5/00
11,156,032 B2 * 10/2021 Grewal ..... E06B 9/52
2005/0050812 A1 * 3/2005 Cameron ..... B60J 1/20 52/204.1
2008/0006375 A1 * 1/2008 Meadows ..... E06B 9/52 160/371
2008/0284596 A1 * 11/2008 Montague ..... G08B 13/19697 340/545.8
2010/0300003 A1 * 12/2010 Goode ..... E06B 3/72 49/504
2010/0307059 A1 * 12/2010 Oberbroeckling .... E06B 3/5892 52/784.1
2010/0307105 A1 * 12/2010 Oberbroeckling .... E06B 3/7001 52/656.9
2012/0006498 A1 * 1/2012 Potter ..... A01K 1/035 160/368.1
2014/0138035 A1 * 5/2014 Potter ..... E04B 2/7427 160/135
2014/0259948 A1 * 9/2014 Oberbroeckling .... E06B 3/5892 49/463
2020/0324423 A1 * 10/2020 Hurwicz ..... B26B 5/005

* cited by examiner

PROTECTIVE SCREEN SYSTEM AND METHOD OF INSTALLATION

CROSS REFERENCE TO RELATED APPLICATION

This application claims the benefit of U.S. Nonprovisional application Ser. No. 15/452,679 filed on Mar. 7, 2017, and U.S. Nonprovisional application Ser. No. 16/690,018 Nov. 20, 2019. The above identified patent applications are herein incorporated by reference in their entirety.

BACKGROUND OF THE INVENTION

The present invention relates to screen systems. The present invention further provides a method for replacing an existing screen within a door or window frame with a protective screen member.

Existing screen doors are composed of material that can be easily punctured or frayed by contact with environmental elements, such as debris, strong winds, and the like, as well as impact by pets and people knocking into the screen material. When a screen becomes damaged, the entire screen has to be replaced or an entirely new screen door must be purchased.

Some people choose to replace a screen door with a glass door or other transparent material in order to provide a sturdier barrier between the interior and exterior of a home when an exterior door is open. However, these doors do not allow airflow to pass through into the interior of a home.

There exist some systems that provide a rigid screen member that can be pivotally attached to an exterior door. However, these systems do not replace the existing screen member and require additional effort to open and close multiple hinged doors to attain a desired airflow, as well as protective barrier. Other systems exist that require a modified door or window frame that only allows insertion through an exterior perimeter of the frame. Some screen systems have a locking system that only allow the screen panel to be attached to the door frame in a singular and unique manner. These methods and systems do not allow a user to replace a screen on an existing door frame. Therefore, there exists a need for a method of replacing a screen with a protective screen system on an existing door frame or window frame.

In light of the devices disclosed in the known art, it is submitted that the present invention substantially diverges in design elements and methods from the known art and consequently it is clear that there is a need in the art for an improvement for methods of installing a protective screen system. In this regard the instant invention substantially fulfills these needs.

SUMMARY OF THE INVENTION

In view of the foregoing disadvantages inherent in the known types of installation methods for protective screen systems now present in the known art, the present invention provides a new installation method wherein a protective screen barrier replaces an existing screen.

It is an objective of the present invention to provide a protective screen system and method comprising removing an existing screen from a door or window frame and inserting a protective screen member through a front face of the frame. The protective screen member is a rigid, transparent panel having a plurality of spaced apertures forming a grid pattern. The protective screen member is positioned through an opening of the frame and within a groove thereof such that an entire outer perimeter of the protective screen member is seated within the door or window frame. The protective screen member is secured to the frame via application of a fastener such as an adhesive or tape.

It is therefore an object of the present invention to provide a new and improved protective screen system and method of installation thereof that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for replacing an existing screen with a protective screen member. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment.

Figure 1:
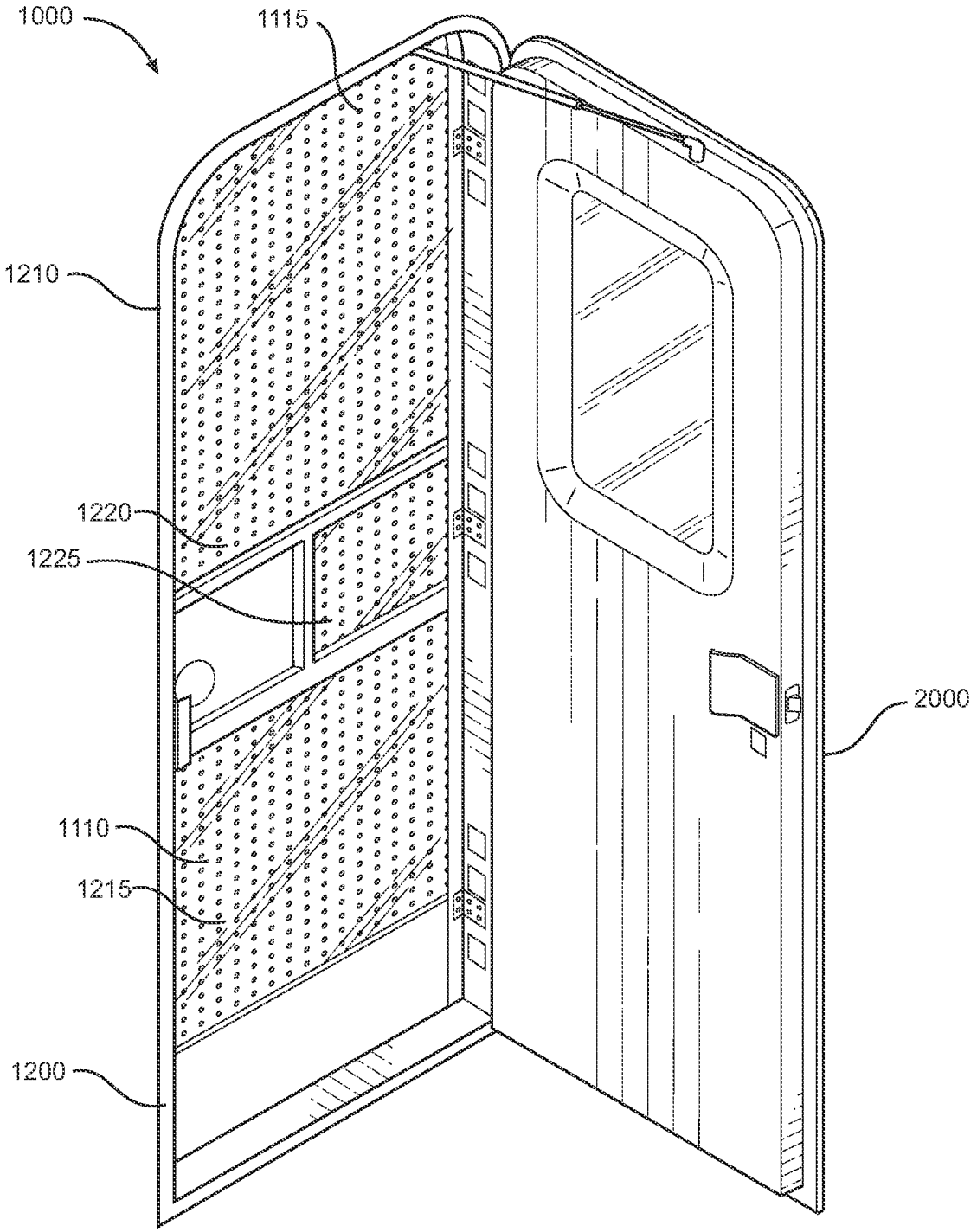
FIG. 1 shows a perspective view of an embodiment of the protective screen member secured to a door frame.

Referring now to FIG. 1, there is shown a perspective view of an embodiment of the protective screen member secured to a door frame. The protective screen system 1000 comprises a protective screen member 1100 adapted to be secured within an existing screen door 1200. When referring to a screen door of the present invention, a screen door can be any door or window having a pre-existing screen therein. In the illustrated embodiment, the screen door is interior to a main exterior door 2000 and is intended to allow air to flow from an exterior of a room or building to an interior of the room or building. However, in alternate embodiments, the screen door is exterior to the main exterior door. A pre-existing screen material refers to a mesh or netting of wire or plastic intended to prevent bugs and insects from passing therethrough.

In the illustrated embodiment, the screen door 1200 is a recreational vehicle (RV) screen door comprising multiple screen sections within the frame 1210 of the screen door 1200. The screen door 1200 comprises a lower section 1215, an upper section 1220, and a middle section 1225. In alternate embodiments, the screen door comprises only a single section configured to receive a protective screen member therein. Each section is configured to receive a protective screen member 1100 therein. In some embodiments, the protective screen member extends a substantial length of the door or window frame when mounted thereto. In some embodiments, the protective screen member comprises a length of 24 inches to fit a standard RV screen door. In other embodiments, the protective screen member comprises between 8-14 inches to fit a sliding screen of a standard RV screen door. The sliding screen is represented as the middle section 1225 of the screen door. In other embodiments, the protective screen member extends a partial length of the door frame. The length is measured between a pair of lateral sides of the door frame.

In the illustrated embodiment, the protective screen member 1100 comprises a front side, a back side, and a width, wherein the front and back sides have planar surfaces. The protective screen member 1100 is transparent to allow a user to see through the protective screen system 1000. In some embodiment, a lower section 1215 of the screen door 1200 comprises a pet door disposed through the protective screen member 1100. The protective screen member 1100 comprises a plurality of apertures 1115 extending through the front and back sides. In the illustrated embodiment, each aperture comprises a diameter of approximately 0.0625 inch and are equidistantly spaced a minimum of 0.25 inches from one another. However, in alternate embodiments, the apertures comprise any suitable size adapted to prevent bugs and insects from passing therethrough and any suitable distance therebetween. In some embodiments, the space between adjacent apertures in the protective screen member is larger than the diameter of the apertures. In some embodiments, the space between adjacent apertures is between 5 to 20 times larger than the diameter of the apertures. This is the inverse of typical residential screens in which the apertures are much larger than the space between the apertures. The result of the ratio of aperture size to distance between adjacent apertures is that the protective screen member 1100 is much stronger than traditional pre-existing screen material. The width is defined as the distance between the front and back sides of the protective screen member 1100. In the illustrated embodiment, the width is approximately 0.080". However, in alternate embodiments the width is any suitable size adapted to fit within a groove of the screen door or window frame.

In the illustrated embodiment, the protective screen member 1100 is formed from a transparent, impact resistant material, such as clear plastic or plexiglass. In some embodiments, the protective screen member is translucent to prevent complete visibility therethrough while still allowing light to pass through the material. The protective screen member comprises a substantially rectangular shape. However, in alternate embodiments, the protective screen member comprises any suitable shape adapted to fit within a perimeter of the screen door frame.

Figure 2:
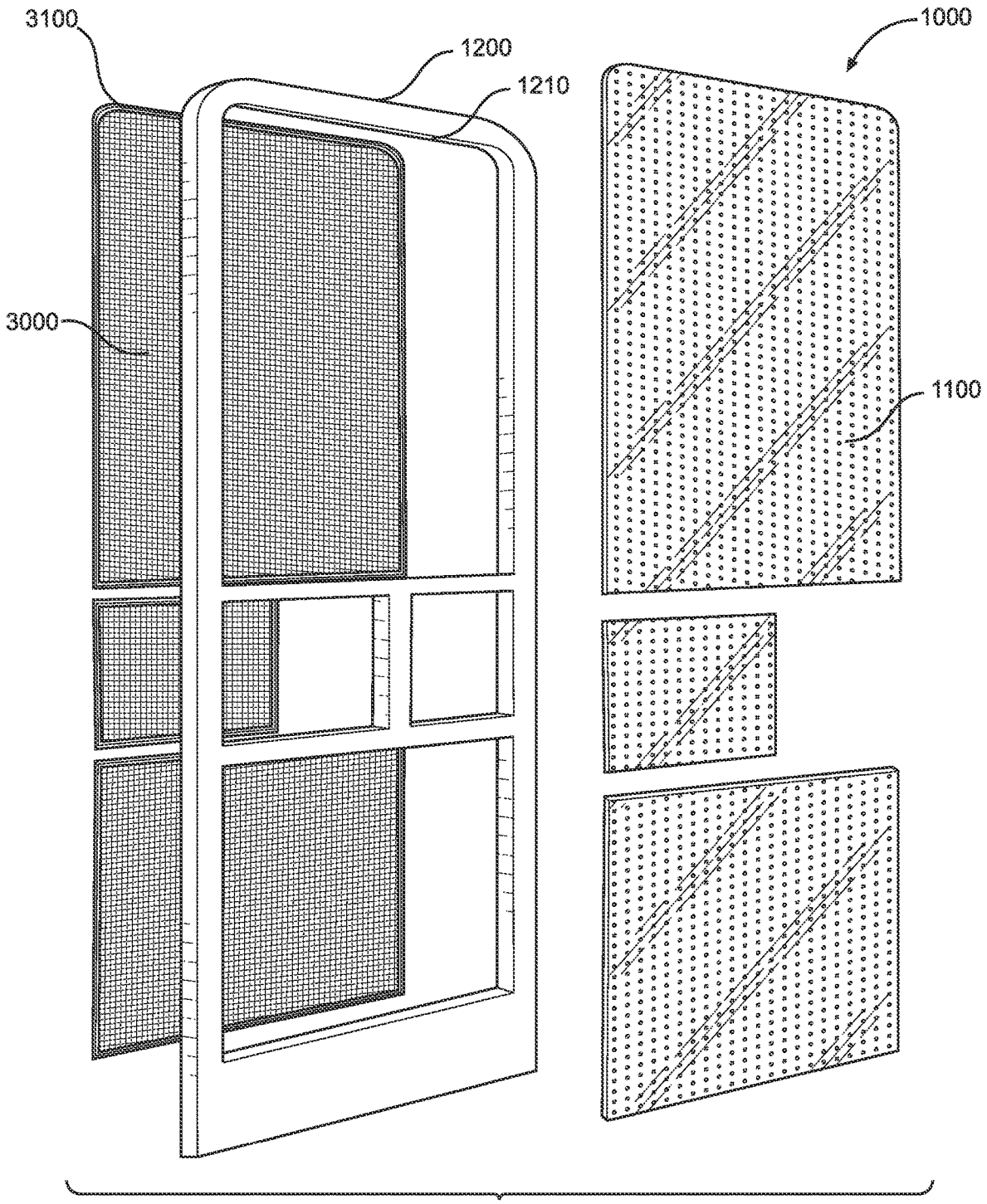
FIG. 2 shows an exploded view of an embodiment of the protective screen member replacing an existing screen of a door frame.

Referring now to FIG. 2, there is shown an exploded view of an embodiment of the protective screen member replacing an existing screen of a door frame. A method of installing the protective screen member 1100 comprises removing a pre-existing screen or screen material 3000 from a door or window frame 1210 of the screen door or window. In the illustrated embodiment, the screen material 3000 is cut along a perimeter of the frame 1215. In some embodiments, a spline or plastic trim used to fasten the screen material 3000 to the frame 1210 is removed. In some embodiments, the protective screen member 1100 is cut to a size adapted to fit within an opening of the door or window frame 1215 such that the outer perimeter of the protective screen member 1100 comprises at least the same dimension as the perimeter of the opening of the door or window frame. In other embodiments, the protective screen member 1100 is already sized to be received within the door frame.

Figure 3:
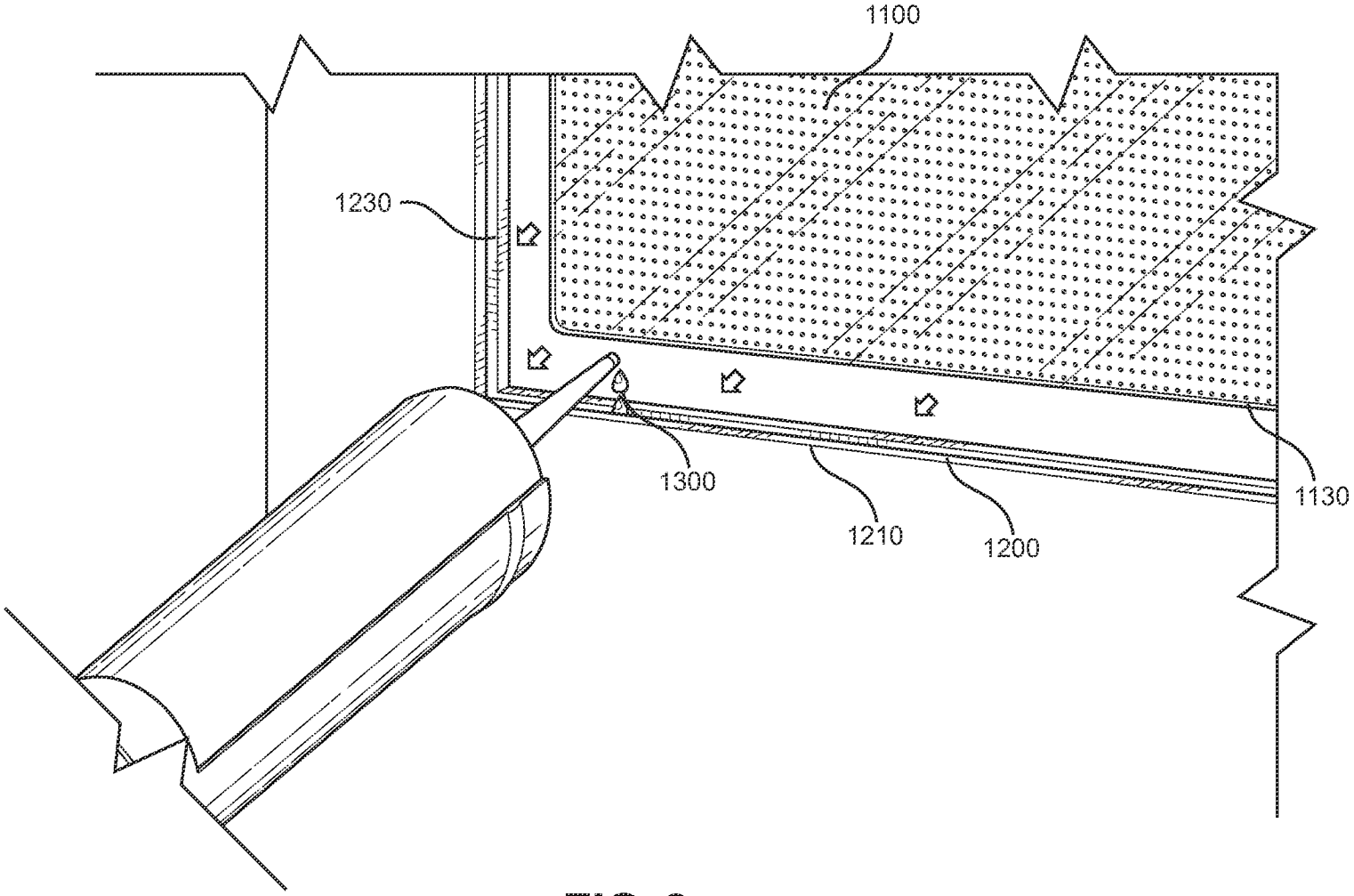
FIG. 3 shows a perspective view of inserting the protective screen member into a groove of an existing door frame.

Referring now to FIG. 3, there is shown a perspective view of inserting the protective screen member into a groove of an existing door frame. Once the pre-existing screen material is completely removed from the existing door frame 1210 of the screen door 1200, the protective screen member 1100 is inserted through a front face of the door frame or window frame. An edge 1130 of the protective screen member 1100 is positioned within a groove 1230 of the door or window frame such that an entire outer perimeter of the protective screen member 1100 is seated within the door or window frame. In some embodiments, the protective screen member 1100 is secured to the door frame by applying a fastener to the perimeter of the protective screen member to permanently secure the protective screen member to the door or window frame. In some embodiments, the fastener is an epoxy, adhesive, tape, or the like. In alternate embodiments, the protective screen member is not permanently secured within the groove by an additional fastener, wherein the protective screen member 1100 can be easily removed for cleaning or replacement thereof. The insertion of the protective screen member within the groove 1230 prevents movement thereof and maintains the placement of the protective screen member 1230 until a user manually lifts the screen member for removal thereof.

The method of installing a protective screen member does not require insertion of the protective screen member through an exterior edge of the door or window. All of the outermost perimeters of the protective screen member remain cooperatively fixed to the door or the window frame in all mounted configurations thereof, wherein a mounted configuration defined as any configuration in which the protective screen member is attached to the door or the window.

The method of installing the protective screen member comprises removing an existing screen from a door or window frame; inserting the protective screen member through a front face of the door frame or window frame, wherein the protective screen member is a rigid, transparent panel having a plurality of spaced apertures forming a grid pattern; removing a spline that secures the existing screen to the door or window frame; positioning the protective screen member within a groove of the door or window frame such that an entire outer perimeter of the protective screen member is seated within the door or window frame; and securing the protective screen member to the door or window frame.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of installing a protective screen member, comprising:

removing an existing screen from a door or window frame via cutting along a perimeter of the existing screen to separate the existing screen from the door or window frame, wherein the door or window frame comprises a substantially flat exterior perimeter extending therearound;

providing the protective screen member comprising a rigid, transparent panel having a plurality of spaced apertures forming a grid pattern;

inserting the protective screen member through a front or rear face of the door or window frame, wherein the front face and the rear face are each a plane that is coplanar with the exterior perimeter of the door or window frame and aligned with an outermost surface of the door or window frame;

positioning the protective screen member within a groove of the door or window frame such that an entire outer perimeter of the protective screen member is seated within the door or window frame;

securing the protective screen member to the door or window frame;

applying a layer of epoxy to the perimeter of the protective screen member to permanently secure the protective screen member to the door or window frame.

2. The method of installing a protective screen member of claim 1, wherein the protective screen member extends a substantial length of the door or window frame when mounted thereto.

3. The method of installing a protective screen member of claim 1, wherein the protective screen member mounts within an opening of the door or window frame without requiring insertion of the protective screen member through an exterior edge of the door or window frame.

4. The method of installing a protective screen member of claim 1, wherein all outermost perimeters of the protective screen member remain cooperatively fixed to the door or window frame in all mounted configurations thereof, the mounted configuration defined as any configuration in which the protective screen member is attached to the door or the window frame.

5. The method of installing a protective screen member of claim 1, wherein the screen member is entirely transparent.

6. The method of installing a protective screen member of claim 1, further comprising removing a spline that secures the existing screen directly to the door or window frame.

7. The method of installing a protective screen member of claim 1, wherein the protective screen member is at least 0.080" thick to fit within the groove.

8. The method of installing a protective screen member of claim 1, further comprising cutting the protective screen member to a size that corresponds with an opening of the door or window frame.

9. The method of installing a protective screen member of claim 1, providing a second protective screen member and installing the second protective screen member within the door or window frame.

10. A method of installing a protective screen member, comprising:

removing an existing screen from a door or window frame via cutting along a perimeter of the existing screen to separate the existing screen from the door or window frame, wherein the door or window frame comprises a substantially flat exterior perimeter extending therearound;

providing a first protective screen member comprising is a rigid, transparent panel having a plurality of spaced apertures forming a grid pattern;

inserting the first protective screen member through a front or rear face of the door or window frame, wherein the front face and the rear face are each a plane that is coplanar with the exterior perimeter of the door or window frame and aligned with an outermost surface of the door or window frame;

positioning the first protective screen member within a groove of the door or window frame such that an entire outer perimeter of the first protective screen member is seated within the door or window frame;

securing the first protective screen member to the door or window frame;

providing a second protective screen member and installing the second protective screen member within the door or window frame;

applying a layer of epoxy to the perimeter of the first protective screen member to permanently secure the first protective screen member to the door or window frame.

11. The method of installing a protective screen member of claim 10, wherein the first protective screen member and the second protective screen member extends a substantial length of the door or window frame when mounted thereto.

12. The method of installing a protective screen member of claim 10, wherein the first and second protective screen members mount within an opening of the door or window frame without requiring insertion of the protective screen member through an exterior edge of the door or window frame.

13. The method of installing a protective screen member of claim 10, wherein all outermost perimeters of the first and second protective screen member remain cooperatively fixed to the door or window frame in all mounted configurations thereof, the mounted configuration defined as any configuration in which the protective screen member is attached to the door or the window frame.

14. The method of installing a protective screen member of claim 10, wherein the first and second screen members are entirely transparent.

15. The method of installing a protective screen member of claim 10, further comprising removing a spline that secures the existing screen directly to the door or window frame.

16. The method of installing a protective screen member of claim 10, wherein the first and second protective screen member is at least 0.080" thick to fit within the groove.

17. The method of installing a protective screen member of claim 10, further comprising cutting the first protective screen member to a size that corresponds with an opening of the door or window frame.

* * * * *